US009627157B1

(12) United States Patent
Tsai

(10) Patent No.: US 9,627,157 B1
(45) Date of Patent: Apr. 18, 2017

(54) KEYBOARD

(71) Applicant: Primax Electronics Ltd., Neihu, Taipei (TW)

(72) Inventor: Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/047,400

(22) Filed: Feb. 18, 2016

(30) Foreign Application Priority Data

Dec. 30, 2015 (CN) ..... 2015 1 1023251

(51) Int. Cl.
*H01H 13/70* (2006.01)
*H01H 13/20* (2006.01)

(52) U.S. Cl.
CPC ..... *H01H 13/70* (2013.01); *H01H 13/20* (2013.01); *H01H 2221/032* (2013.01); *H01H 2231/002* (2013.01)

(58) Field of Classification Search
CPC .. H01H 13/70; H01H 13/20; H01H 2221/032; H01H 2231/002
USPC ..... 200/5 A, 341, 344, 345, 520
See application file for complete search history.

(56) References Cited

U.S. PATENT DOCUMENTS

2005/0217983 A1* 10/2005 Hsu ..... G06F 1/1615 200/5 A
2014/0138228 A1* 5/2014 Chen ..... H01H 13/83 200/5 A
2015/0101917 A1* 4/2015 Yen ..... H01H 13/84 200/5 A
2015/0332875 A1* 11/2015 Hsu ..... H01H 13/7065 200/344

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A keyboard including a fixing plate, a base plate, and a plurality of keys is provided. The base plate includes a plurality of magnetic elements, and each magnetic element corresponds to one key. Each key further includes a first support element and a second support element, and the first support element is made of a magnetic material. The key is disposed on the fixing plate, and the base plate may move relative to the fixing plate, so that the magnetic element is displaced and attracts the first support element to ascend or descend, so as to adjust the height of the key.

11 Claims, 5 Drawing Sheets

KEYBOARD

FIELD OF THE INVENTION

The present invention relates to a keyboard, and more particularly to a keyboard of which a key height can be adjusted.

BACKGROUND OF THE INVENTION

A keyboard is one of input devices that are mostly used by people when using electronic devices at present. A keyboard is provided with a plurality of keys for being pressed by a user, and the key can move up and down to trigger a circuit to generate an input signal. Therefore, the keys are all designed to have a certain height, which varies along with different sizes of keyboards and corresponding electronic devices. For example, a height of a key in a keyboard for a desktop computer is relatively high, to make it convenient to press and improve hand feeling, and a height of a notebook computer is relatively low, to make it convenient to open and close a screen.

At present, many electronic devices become thinner and lighter, but a key height is set during manufacturing, and it is impossible to change the height to fit a thin and light electronic device, or equipment for adjusting the height needs to be provided additionally, which makes it impossible to effectively reduce a whole thickness apart from making it inconvenient to store. Therefore, a conventional keyboard still needs to be improved.

SUMMARY OF THE INVENTION

To resolve the problem of the prior art, the present invention provides a keyboard, of which a key height can be adjusted, so as to facilitate storage and reduce a thickness, an accessory for height adjustment needs not to be provided additionally, and an effect of changing a height can be reached by using an original structure of a key.

To achieve the foregoing object, a keyboard of the present invention includes:

a fixing plate;

a plurality of keys, disposed on the fixing plate, where each key includes:

a key cap;

a first support element, disposed below the key cap and connecting the key cap and the fixing plate, where the first support element is made of a magnetic material;

a second support element, pivotally connected to the first support element and connecting the key cap and the fixing plate; and a base plate, disposed below the fixing plate, and capable of moving relative to a bottom of the fixing plate, where the base plate includes:

a plurality of magnetic elements, magnetically attracting the first support element and capable of moving relative to the base plate to generate a displacement, where one of the magnetic elements is corresponding to one of the keys, the first support element and the second support element support the key cap to be at a first height when the magnetic element is displaced to a first position below the fixing plate; and the magnetic element attracts the first support element, so that the first support element and the second support element pull the key cap to descend to a second height when the magnetic element is displaced to a second position below the fixing plate, so as to adjust the height of the key.

Preferably, the first support element further includes an elevator terminal, where the elevator terminal is connected to the key cap, the elevator terminal is spaced from the fixing plate at a distance when the magnetic element is displaced to the first position, so that the key cap is located at the first height, and the elevator terminal descends due to magnetic attraction when the magnetic element is displaced to the second position, so that the elevator terminal is moved towards the fixing plate, so as to descend the key cap to the second height.

Preferably, the first support element further comprises a connecting terminal, where the connecting terminal is connected to the fixing plate, the first position is located below the connecting terminal, the second position is located below the elevator terminal, and the magnetic element is displaced between the first position and the second position.

Preferably, the base plate moves in parallel to the bottom of the fixing plate.

Preferably, the keyboard further includes an elastic element, disposed below the key cap, and configured to support the key cap to be at the first height.

Preferably, an attraction force for attracting the first support element by the magnetic element is greater than a support force for supporting the key cap by the elastic element when the magnetic element is displaced to the second position, so as to descend the key cap to the second height.

Preferably, the elastic element is surrounded by the first support element and the second support element.

Preferably, the keyboard further includes a thin-film circuit layer, disposed above the fixing plate.

Preferably, the first support element is made of metal.

Preferably, the first support element is made of magnetite.

Preferably, the first support element and the second support element are of a scissor-shaped structure.

DETAILED DESCRIPTION OF THE PREFERRED EMBODIMENT

The present invention is described below with preferred embodiments in combination with the accompanying drawings.

Figure 1:
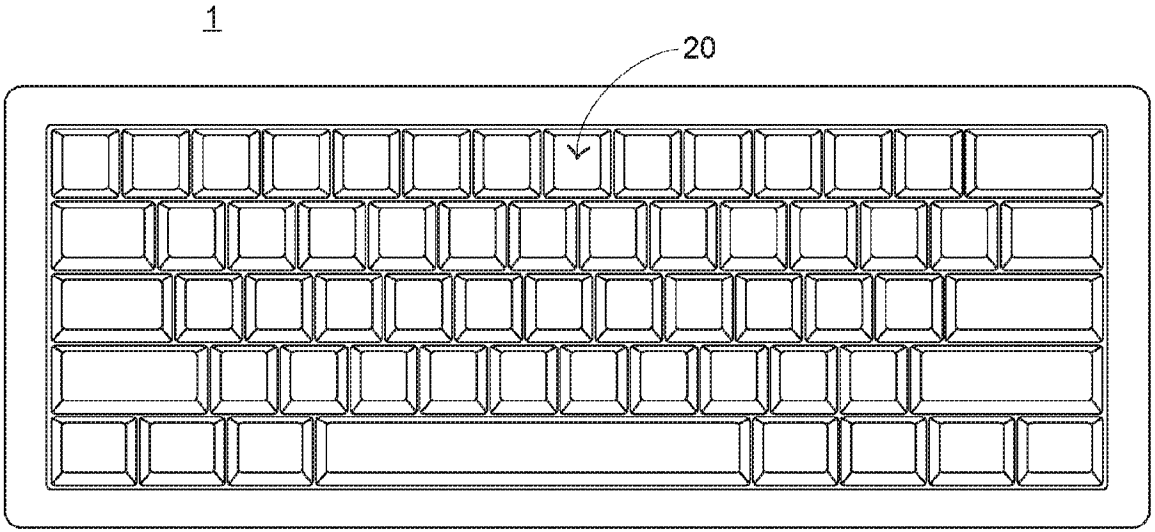
FIG. 1 is a top view of a preferred embodiment of a keyboard of the present invention.
Figure 2:
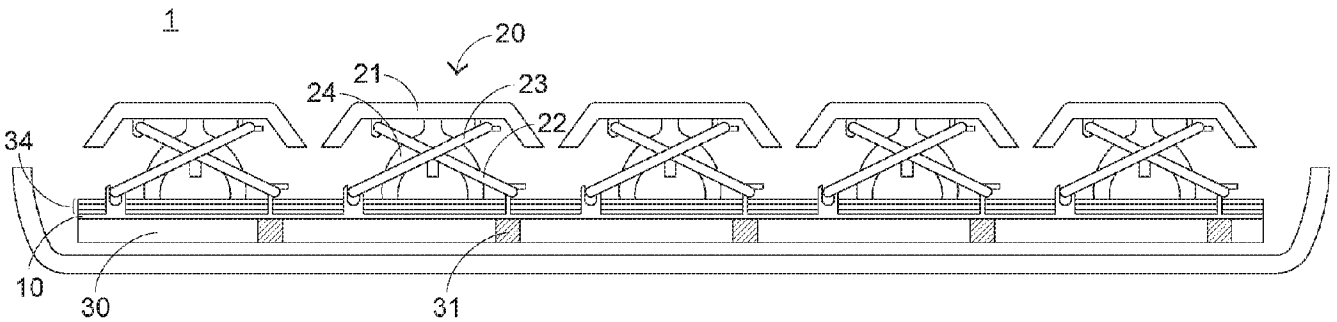
FIG. 2 is a sectional view of a preferred embodiment of the present invention.

First, referring to FIG. 1 and FIG. 2, FIG. 1 is a top view of a preferred embodiment of a keyboard of the present invention. FIG. 2 is a sectional view of a preferred embodiment of the present invention. A keyboard 1 of the present invention includes: a fixing plate 10, a plurality of keys 20, and a base plate 30. The plurality of keys 20 is disposed on the fixing plate 10. The base plate 30 is disposed below the fixing plate 10 and is capable of moving relative to a bottom of the fixing plate 10. Each key 20 includes a key cap 21, a first support element 22, and a second support element 23. The base plate 30 includes a plurality of magnetic elements 31. The key cap 21 is disposed above the fixing plate 10. The first support element 22 is disposed below the key cap 21 and connects the key cap 21 and the fixing plate 10, and the first support element 22 is made of a magnetic material. The second support element 23 is pivotally connected to the first support element 22 and connects the key cap 21 and the fixing plate 10. The plurality of magnetic elements 31 is disposed on the base plate 30, magnetically attracts the first support element 22, and may be displaced relative to the base plate 30. One of the magnetic elements 31 is corresponding to one of the keys 20. The first support element 22 and the second support element 23 support the key cap 21 to be at a first height H1 (see FIG. 4) when the base plate 30 carries the magnetic element 31 to move to a first position S1 (see FIG. 4) below the fixing plate 10. The magnetic element 31 attracts the first magnetic member 22, so that the first magnetic member 22 and the second magnetic member 23 pull the key cap 21 to descend to a second height H2 (see FIG. 5) when the magnetic element 31 is moved to a second position S2 (see FIG. 5) below the fixing plate 10, so as to adjust the height of the key 20.

Figure 3:
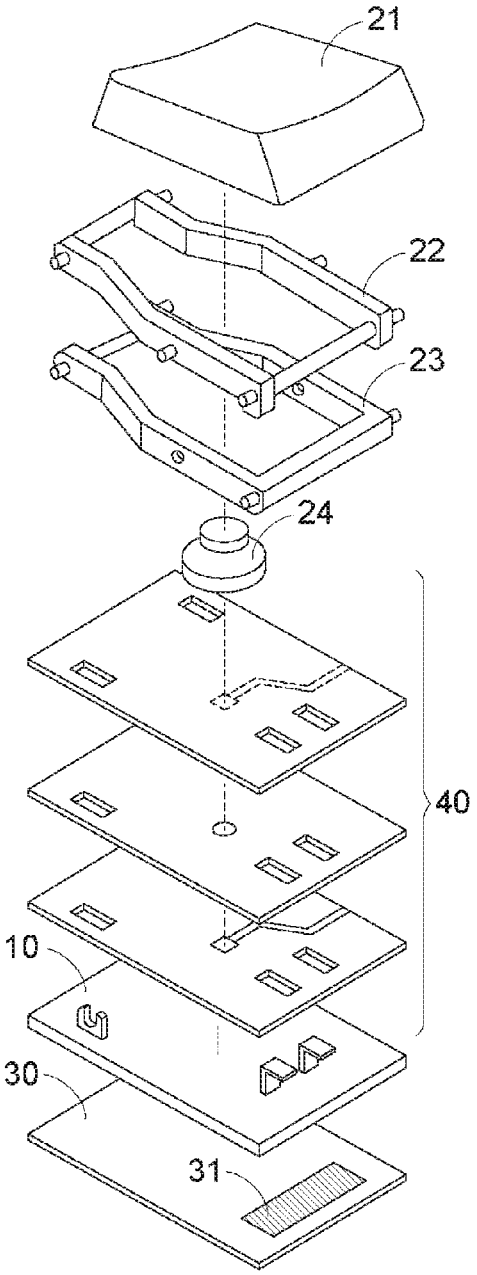
FIG. 3 is a three-dimensional exploded view of a key according to a preferred embodiment of the present invention.
Figure 4:
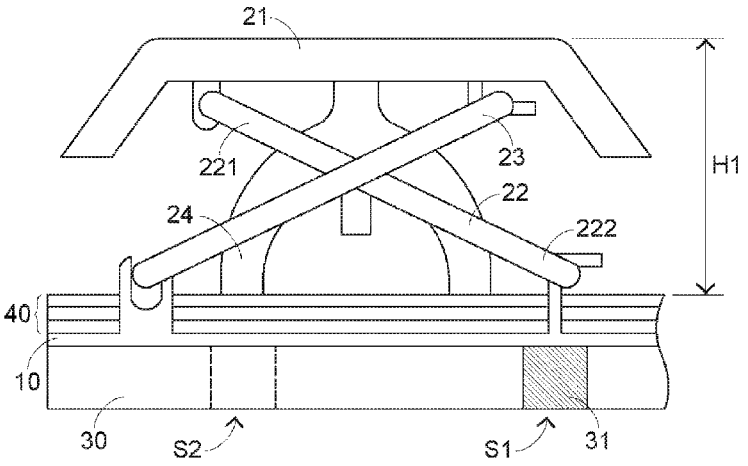
FIG. 4 is a schematic diagram of a key according to a preferred embodiment of the present invention.

Continuously referring to FIG. 3 and FIG. 4, FIG. 3 is a three-dimensional exploded view of a key according to a preferred embodiment of the present invention, and FIG. 4 is a schematic diagram of a key according to a preferred embodiment of the present invention. The keyboard 1 further includes a thin-film circuit layer 40. Each key 20 further includes an elastic element 24. The first support element 22 further includes an elevator terminal 221 and a connecting terminal 222. The thin-film circuit layer 40 is disposed above the fixing plate 10 and is located below the plurality of keys 20. The elastic element 24 is disposed below the key cap 21, the elastic element 24 is configured to trigger the thin-film circuit layer 40 and support the key cap 21, and the elastic element 24 is surrounded by the first support element 22 and the second support element 23. The elevator terminal 221 is connected to the key cap 21, and the connecting terminal 222 is connected to the fixing plate 10. The first position S1 is located below the connecting terminal 222, and the second position S2 is located below the elevator terminal 221. The magnetic element 31 is displaced between the first position S1 and the second position S2.

Figure 5:
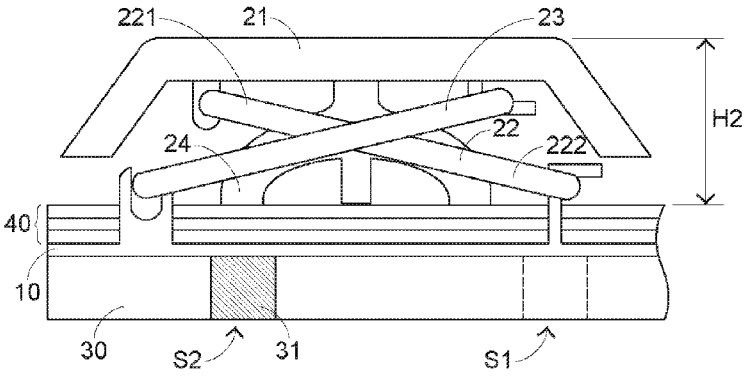
FIG. 5 is a schematic diagram of a key according to a preferred embodiment of the present invention.

Continuously referring to FIG. 4 and FIG. 5, FIG. 4 and FIG. 5 are schematic diagrams of the key according to preferred embodiments of the present invention. The magnetic element 31 is located in the base plate 30 and magnetically attracts the first support element 22, separated by the fixing plate 10 and the thin-film circuit layer 40. An attraction force for attracting the first support element 22 by the magnetic element 31 is less than a support force for supporting the key cap 21 by the elastic element 24 when the magnetic element 31 is located at the first position S1. Therefore, the elevator terminal 221 is spaced from the fixing plate 10 at a distance and enables the key cap 21 to be at the first height H1. An attraction force for attracting the first support element 22 by the magnetic element 31 is greater than a support force for supporting the key cap 21 by the elastic element 24 when the magnetic element 31 is carried by the base plate 30 to move, in parallel to the bottom of the fixing plate 10, to the second position S2, so that the elevator terminal 221 descends, moves in a direction towards the fixing plate 10, and carries the key cap 21 to descend to the second height H2.

Figure 6:
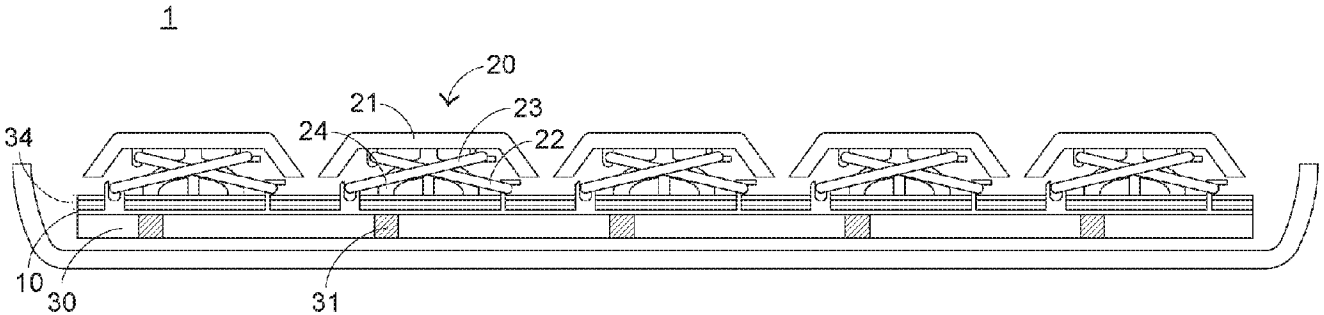
FIG. 6 is a sectional view of a preferred embodiment of the present invention.

The key cap 21 is maintained at the first height H2, so that the key 20 may be pressed to trigger the thin-film circuit layer 40 to generate an input signal when the magnetic element 31 is located at the first position S1. When the magnetic element 31 is located at the second position S2, referring to a sectional view of a preferred embodiment of the present invention in FIG. 6, the height of the whole key 20 is descended and maintained at the second height H2, so that a height and thickness of the whole keyboard is reduced.

The first support element 22 is made of metal or magnetic material, so that the magnetic element 31 is capable of attracting the first support element 22. The first support element 22 and the second support element 23 are of a scissor-shaped structure. Therefore, an effect of ascending or descending a key of a keyboard can be achieved without changing a structure of an original keyboard key or adding an extra device or element, thereby resolving the problems of the prior art.

The above are only preferred embodiments of the present invention and are not intended to limit the scope of the claims of the present invention. Therefore, any equivalent modifications or variations made without departing from the disclosed spirit of the present invention should all fall within the scope of protection of the present invention.

What is claimed is:

1. A keyboard, comprising:

a fixing plate;

a plurality of keys, disposed on the fixing plate, wherein each key comprises:

a key cap;

a first support element, disposed below the key cap and connecting the key cap and the fixing plate, wherein the first support element is made of a magnetic material;

a second support element, pivotally connected to the first support element and connecting the key cap and the fixing plate; and a base plate, disposed below the fixing plate, and capable of moving relative to a bottom of the fixing plate, wherein the base plate comprises:

a plurality of magnetic elements, magnetically attracting the first support element and capable of moving relative to the base plate to generate a displacement, wherein one of the magnetic elements is corresponding to one of the keys, the first support element and the second support element support the key cap to be at a first height when the magnetic element is displaced to a first position below the fixing plate; and the magnetic element attracts the first support element, so that the first support element and the second support element pull the key cap to descend to a second height when the magnetic element is displaced to a second position below the fixing plate, so as to adjust the height of the key.

2. The keyboard according to claim 1, wherein the first support element further comprises an elevator terminal, wherein the elevator terminal is connected to the key cap, the elevator terminal is spaced from the fixing plate at a distance when the magnetic element is displaced to the first position, so that the key cap is located at the first height, and the elevator terminal descends due to magnetic attraction when the magnetic element is displaced to the second position, so that the elevator terminal is moved towards the fixing plate, so as to descend the key cap to the second height.

3. The keyboard according to claim 2, wherein the first support element further comprises a connecting terminal, wherein the connecting terminal is connected to the fixing plate, the first position is located below the connecting terminal, the second position is located below the elevator terminal, and the magnetic element is displaced between the first position and the second position.

4. The keyboard according to claim 1, wherein the base plate is moved in parallel to the bottom of the fixing plate.

5. The keyboard according to claim 1, wherein the keyboard further comprises an elastic element, disposed below the key cap, and configured to support the key cap to be at the first height.

6. The keyboard according to claim 5, wherein an attraction force for attracting the first support element by the magnetic element is greater than a support force for supporting the key cap by the elastic element when the magnetic element is displaced to the second position, so as to descend the key cap to the second height.

7. The keyboard according to claim 5, wherein the elastic element is surrounded by the first support element and the second support element.

8. The keyboard according to claim 1, wherein the keyboard further comprises a thin-film circuit layer, disposed above the fixing plate.

9. The keyboard according to claim 1, wherein the first support element is made of metal.

10. The keyboard according to claim 1, wherein the first support element is made of magnetite.

11. The keyboard according to claim 1, wherein the first support element and the second support element are of a scissor-shaped structure.

* * * * *